US011120736B2

(12) United States Patent
Wu et al.

(10) Patent No.: US 11,120,736 B2
(45) Date of Patent: Sep. 14, 2021

(54) PIXEL CIRCUIT, PIXEL STRUCTURE, AND RELATED PIXEL ARRAY

(71) Applicant: AU Optronics Corporation, Hsin-Chu (TW)

(72) Inventors: Chia-En Wu, Hsin-Chu (TW); Ming-Hsien Lee, Hsin-Chu (TW); Wei-Chia Chiu, Hsin-Chu (TW); Kuan-Yu Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/920,463

(22) Filed: Jul. 3, 2020

(65) Prior Publication Data

US 2021/0134211 A1 May 6, 2021

(30) Foreign Application Priority Data

Nov. 5, 2019 (TW) ..... 108140145

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2300/0819* (2013.01); *G09G 2300/0842* (2013.01); *G09G 2320/0233* (2013.01)

(58) Field of Classification Search
CPC ..... G09G 3/32; G09G 3/2003; G09G 2300/0842; G09G 2320/0233; G09G 2300/0819
See application file for complete search history.

(56) References Cited

U.S. PATENT DOCUMENTS

2009/0040150 A1* 2/2009 Senda ..... G09G 3/3233 345/76
2013/0314305 A1* 11/2013 Liu ..... G09G 3/32 345/77

(Continued)

FOREIGN PATENT DOCUMENTS

CN 104658484 A 5/2015
CN 108305587 A 7/2018

(Continued)

*Primary Examiner* — Jeff Piziali
(74) *Attorney, Agent, or Firm* — McClure, Qualey & Rodack, LLP

(57) ABSTRACT

A pixel circuit including a driving transistor, a light emission element, a compensation circuit, a storage capacitor, and a writing circuit is provided. The light emission control circuit is configured to selectively conduct the light emission element to the driving transistor. The compensation circuit is coupled with the light emission control circuit and a control terminal of the driving transistor, and is configured to form a diode-connected structure with the driving transistor. The storage capacitor includes a first terminal and a second terminal. The first terminal of the storage capacitor is coupled with the control terminal of the driving transistor, and the light emission control circuit is configured to selectively conduct the second terminal of the storage capacitor to a first power terminal. The writing circuit is configured to provide different voltages to the first terminal of the storage capacitor and the second terminal of the storage capacitor.

20 Claims, 11 Drawing Sheets

(56) References Cited

U.S. PATENT DOCUMENTS

| | | | | |
|---|---|---|---|---|
| 2016/0180772 | A1* | 6/2016 | Ma | G09G 3/3233 345/214 |
| 2016/0275854 | A1* | 9/2016 | Wang | G09G 3/3233 |
| 2016/0275861 | A1 | 9/2016 | Yang et al. | |
| 2017/0047002 | A1* | 2/2017 | Xuan | G09G 3/32 |
| 2018/0197469 | A1 | 7/2018 | Lo | |
| 2018/0301105 | A1* | 10/2018 | Kim | G09G 3/3275 |

FOREIGN PATENT DOCUMENTS

| | | | |
|---|---|---|---|
| CN | 109087609 | A | 12/2018 |
| TW | 201942894 | A | 11/2019 |

* cited by examiner

PIXEL CIRCUIT, PIXEL STRUCTURE, AND RELATED PIXEL ARRAY

CROSS-REFERENCE TO RELATED APPLICATION

This application claims priority to Taiwan Application Number 108140145, filed on Nov. 5, 2019, which is herein incorporated by reference in its entirety.

BACKGROUND

Technical Field

The present disclosure generally relates to a pixel circuit. More particularly, the present disclosure relates to a pixel circuit immune to variations of device characteristics.

Description of Related Art

Micro LEDs have the advantages of low power consumption, high color saturation, and high response speed, and thus have become one of the popular technologies applied to the next-generation display panels. However, the Micro LED pixel circuits located in different areas of the display panel may have different device characteristics due to manufacturing process factors, and the Micro LED pixel circuits also face different power line impedances, causing the displayed pictures having non-uniform luminance.

SUMMARY

The disclosure provides a pixel circuit including a driving transistor, a light emission element, a compensation circuit, a storage capacitor, and a writing circuit. The light emission control circuit is configured to selectively conduct the light emission element to the driving transistor. The compensation circuit is coupled with the light emission control circuit and a control terminal of the driving transistor, and is configured to form a diode-connected structure with the driving transistor. The storage capacitor includes a first terminal and a second terminal. The first terminal of the storage capacitor is coupled with the control terminal of the driving transistor, and the light emission control circuit is configured to selectively conduct the second terminal of the storage capacitor to a first power terminal. The writing circuit is configured to provide different voltages to the first terminal of the storage capacitor and the second terminal of the storage capacitor.

The disclosure provides a pixel array including a plurality of pixel circuits arranged to from n pixel rows, and n is a positive integer. Each of the n pixel rows receives corresponding three of a plurality of first gate control signals as a first control signal, a second control signal, and a third control signal. Each of the plurality of pixel circuits Includes a driving transistor, a light emission element, a light emission control circuit, a compensation circuit, a storage capacitor, and a writing circuit. The light emission control circuit is configured to selectively conduct the light emission element to the driving transistor. The compensation circuit is coupled with the light emission control circuit and a control terminal of the driving transistor, and is configured to form a diode-connected structure with the driving transistor according to the third control signal. The storage capacitor includes a first terminal and a second terminal. The first terminal of the storage capacitor is coupled with the control terminal of the driving transistor, and the light emission control circuit is configured to selectively conduct the second terminal of the storage capacitor to a first power terminal. The writing circuit is configured to provide, according to the first control signal and the second control signal, different voltages to the first terminal of the storage capacitor and the second terminal of the storage capacitor.

The disclosure provides a pixel structure including a first pixel, a second pixel, and a third pixel. Each of the first pixel, the second pixel, and the third pixel includes a driving transistor, a driving transistor, a light emission control circuit, a compensation circuit, a storage capacitor, and a writing circuit. The light emission control circuit is configured to selective conduct the light emission element to the driving transistor. The compensation circuit is coupled with the light emission control circuit and a control terminal of the driving transistor, and is configured to form a diode-connected structure with the driving transistor. The storage capacitor includes a first terminal and a second terminal. The first terminal of the storage capacitor is coupled with the control terminal of the driving transistor, and the light emission control circuit is configured to selectively conduct the second terminal of the storage capacitor to a first power terminal. The writing circuit is configured to provide different voltages to the first terminal of the storage capacitor and the second terminal of the storage capacitor. The light emission element of the first pixel, the light emission element of the second pixel, and the light emission element of the third pixel are configured to generate red light, green light, and blue light, respectively.

It is to be understood that both the foregoing general description and the following detailed description are by examples, and are intended to provide further explanation of the disclosure as claimed.

DETAILED DESCRIPTION

Figure 1:
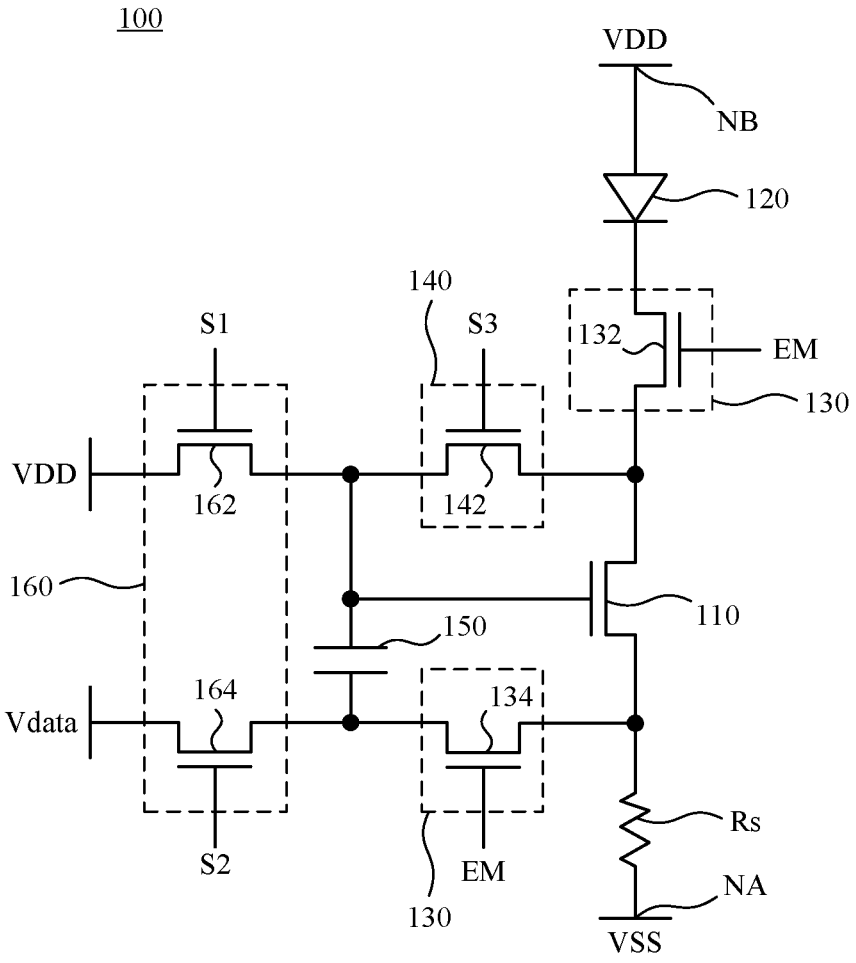
FIG. 1 is a functional block diagram of a pixel circuit 100 according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a functional block diagram of a pixel circuit 100 according to one embodiment of the present disclosure. The pixel circuit 100 comprises a driving transistor 110, a light emission element 120, a light emission control circuit 130, a compensation circuit 140, a storage capacitor 150, and a writing circuit 160. The driving transistor 110 is configured to decide the magnitude of a current flowing through the light emission element 120, so as to decide the luminance of the light emission element 120. The light emission control circuit 130 is coupled between the driving transistor 110 and the light emission element 120, and is configured to selectively conduct the light emission element 120 to the driving transistor 110 in order to determine a time length in which the pixel circuit 100 emits light.

The compensation circuit 140 is coupled with a control terminal of the driving transistor 110 and the light emission control circuit 130. When the compensation circuit 140 is conducted, the compensation circuit 140 forms a diode-connected structure with the driving transistor 110 in order to detect a threshold voltage of the driving transistor 110.

The storage capacitor 150 comprises a first terminal and a second terminal. The first terminal of the storage capacitor 150 is coupled with the control terminal of the driving transistor 110, and the second terminal of the storage capacitor 150 is coupled with the light emission control circuit 130 and the writing circuit 160. The writing circuit 160 is configured to provide a data voltage Vdata to the second terminal of the storage capacitor 150. After the compensation circuit 140 stores the detected threshold voltage at the first terminal of the storage capacitor 150, the light emission control circuit 130 selectively conducts the second terminal of the storage capacitor 150 to a first power terminal NA in order to receive a system low voltage VSS from the first power terminal NA. Therefore, the data voltage Vdata is written to the control terminal of the driving transistor 110 from the second terminal of the storage capacitor 150 because of the capacitive coupling effect. The writing circuit 160 is further configured to provide a system high voltage VDD to the first terminal of the storage capacitor 150 to reset the voltage of the control terminal of the driving transistor 110.

In other words, the pixel circuit 100 is capable of compensation of the threshold voltage variation of the driving transistor 110, and thus display panels implemented with the pixel circuits 100 are capable of displaying pictures with uniform brightness. In this disclosure, the term "compensation" means calibrations which are performed to mitigate the current offset induced by certain factors. For example, after the pixel circuit 100 compensates the threshold voltage variation of the driving transistor 110, the current flowing through the light emission element 120 will have the magnitude substantially irrelevant to the threshold voltage of the driving transistor 110.

As shown in FIG. 1, the light emission control circuit 130 comprises a first light emission transistor 132 and a second light emission transistor 134. Each of the first light emission transistor 132 and the second light emission transistor 134 comprises a first terminal, a second terminal, and a control terminal. The first terminal of the first light emission transistor 132 is coupled with the first terminal (e.g., the cathode) of the light emission element 120, and the second terminal (e.g., the anode) of the light emission element 120 is coupled with a second power terminal NB configured to provide a system high voltage VDD. The second terminal of the first light emission transistor 132 is coupled with the first terminal of the driving transistor 110 and the compensation circuit 140. The first terminal of the second light emission transistor 134 is coupled with the second terminal of the driving transistor 110 and the first power terminal NA. The second terminal of the second light emission transistor 134 is coupled with the second terminal of the storage capacitor 150.

In this embodiment, the control terminal of the first light emission transistor 132 and the control terminal of the second light emission transistor 134 are both configured to receive the light emission signal EM.

The writing circuit 160 comprises a first writing transistor 162 and a second writing transistor 164. Each of the first writing transistor 162 and the second writing transistor 164 comprises a first terminal, a second terminal, and a control terminal. The first terminal of the first writing transistor 162 is coupled with the control terminal of the driving transistor 110. The second terminal of the first writing transistor 162 is configured to receive the system high voltage VDD. The control terminal of the first writing transistor 162 is configured to receive a first control signal S1. The first terminal of the second writing transistor 164 is coupled with the second terminal of the storage capacitor 150. The second terminal of the second writing transistor 164 is configured to receive the data voltage Vdata. The control terminal of the second writing transistor 164 is configured to receive a second control signal S2.

The compensation circuit 140 comprises a compensation transistor 142 comprising a first terminal, a second terminal, and a control terminal. The first terminal of the compensation transistor 142 is coupled with the first terminal of the driving transistor 110. The second terminal of the compensation transistor 142 is coupled with the control terminal of the driving transistor 110. The control terminal of the compensation transistor 142 is configured to receive a third control signal S3.

The resistor Rs of FIG. 1 is not an actually fabricated resistor, but is merely for representing the equivalent impedance of the power line coupled with the pixel circuit 100.

In some embodiments, the transistors of FIG. 1 may be realized by N-type transistors of any suitable categories, such as the thin-film transistors (TFTs), the MOSFETs, etc.

In other embodiments, the light emission element 120 of FIG. 1 is realized by the micro LED.

In yet other embodiments, the light emission element 120 of FIG. 1 is realized by the organic light-emitting diode (OLED).

Figure 2:
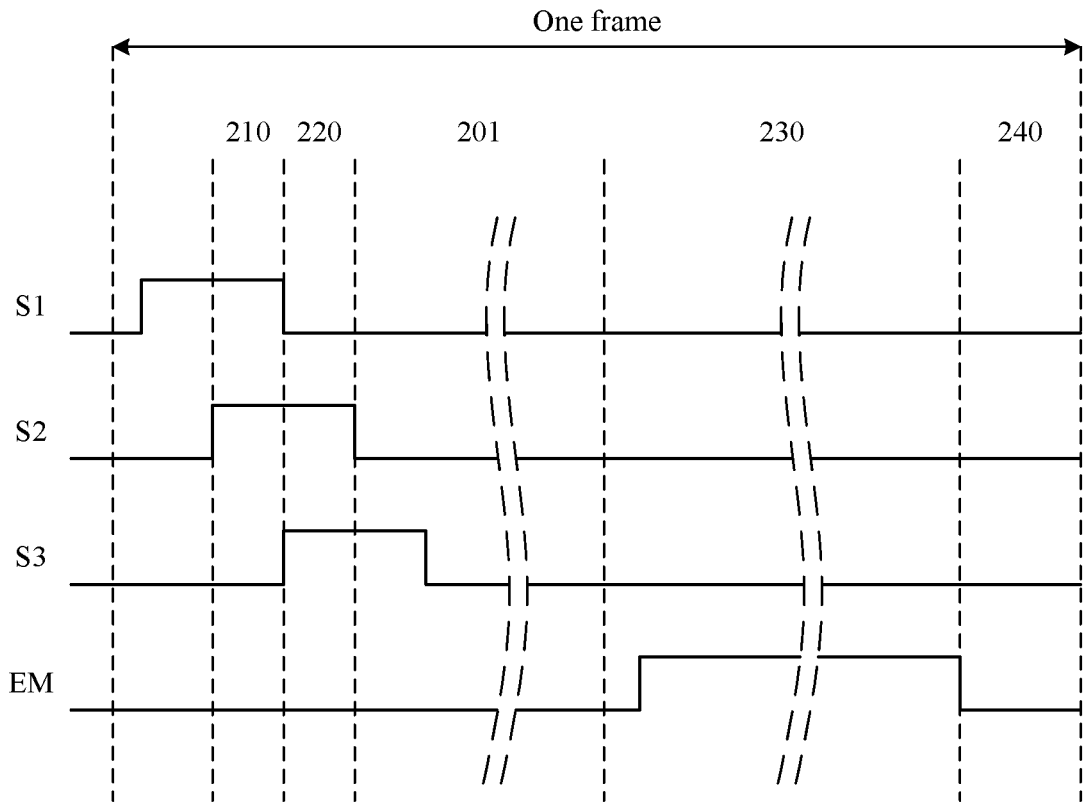
FIG. 2 is a simplified waveform schematic of a plurality of control signals provided to the pixel circuit of FIG. 1 according to one embodiment of the present disclosure.
Figure 3A:
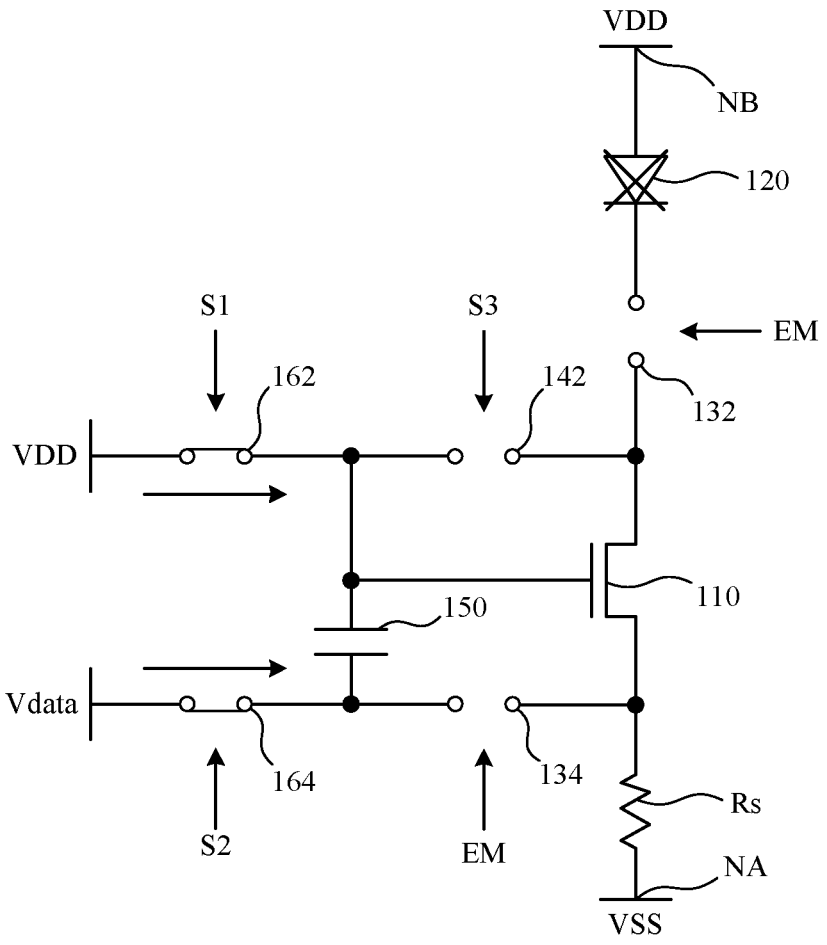
FIG. 3A is a schematic diagram for illustrating an equivalent circuit operation of the pixel circuit of FIG. 1 in a first operation period.
Figure 3B:
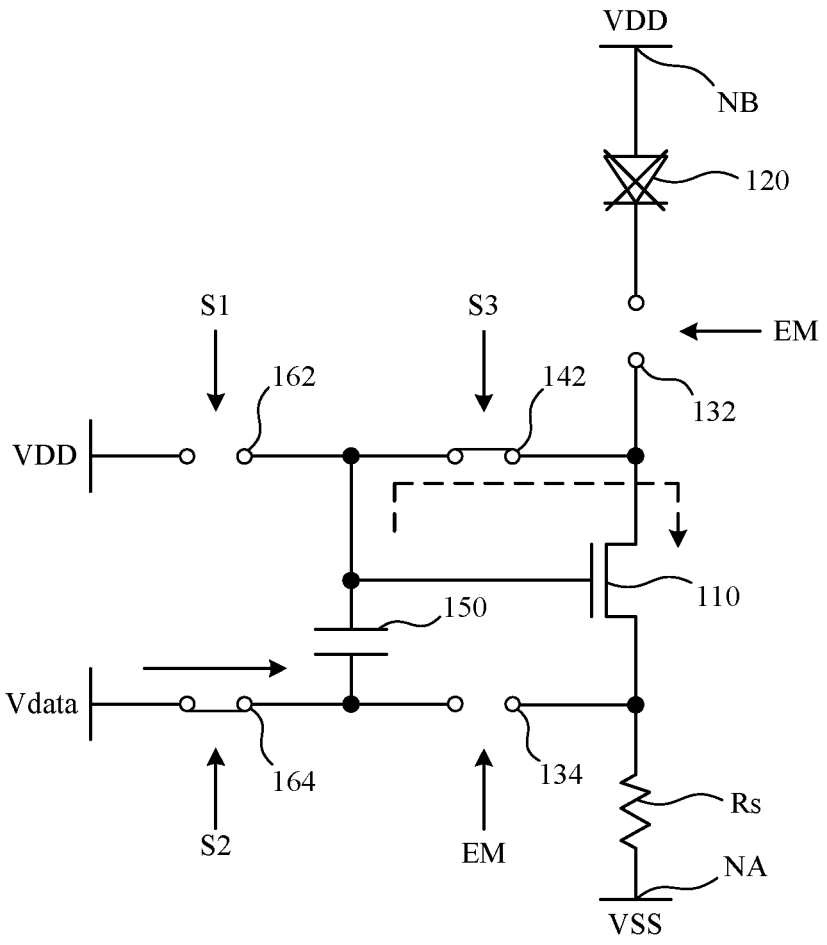
FIG. 3B is a schematic diagram for illustrating an equivalent circuit operation of the pixel circuit of FIG. 1 in a second operation period.
Figure 3C:
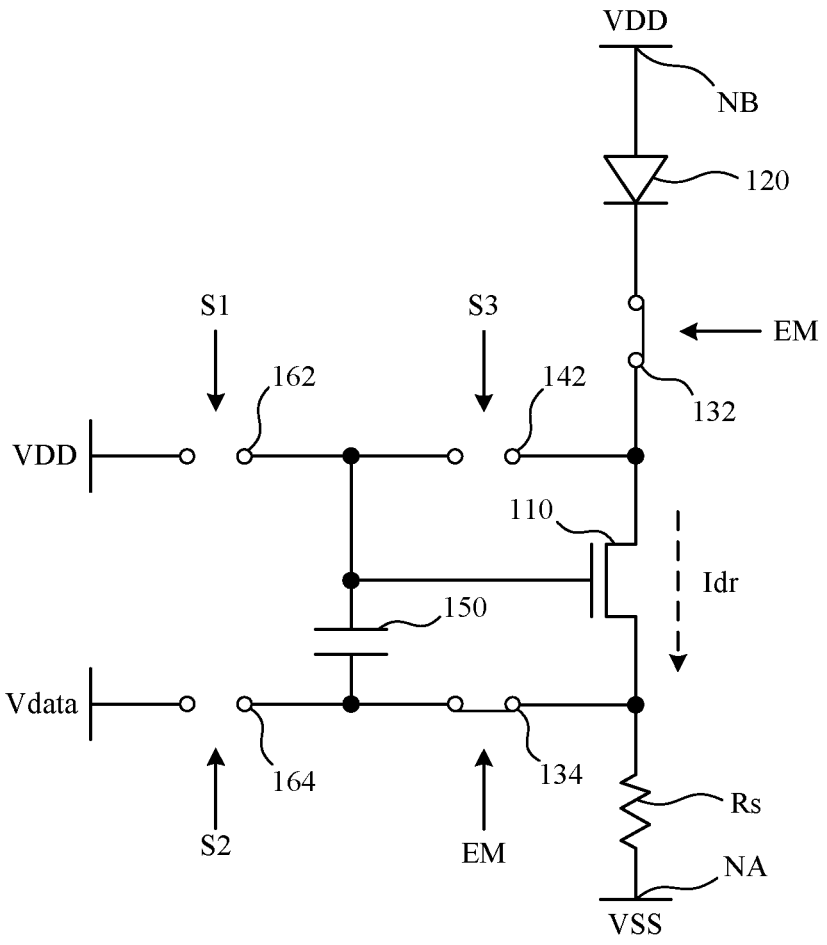
FIG. 3C is a schematic diagram for illustrating an equivalent circuit operation of the pixel circuit of FIG. 1 in a third operation period.

FIG. 2 is a simplified waveform schematic of a plurality of control signals provided to the pixel circuit 100 according to one embodiment of the present disclosure. FIG. 3A is a schematic diagram for illustrating an equivalent circuit operation of the pixel circuit 100 in a first operation period 210. FIG. 3B is a schematic diagram for illustrating an equivalent circuit operation of the pixel circuit 100 in a second operation period 220. FIG. 3C is a schematic diagram for illustrating an equivalent circuit operation of the pixel circuit 100 in a third operation period 230. Reference is made to FIG. 2 and FIG. 3A. In the first operation period 210, the first control signal S1 and the second control signal S2 have a logic high level (e.g., a high voltage that can conduct the N-type transistors), while the third control signal S3 and the light emission signal EM have a logic low level (e.g., a low voltage that can switch off the N-type transistors). The light emission control circuit 130 and the compensation circuit 140 are switched off, that is, the first light emission transistor 132, the second light emission transistor 134, and the compensation transistor 142 are switched off. The first writing transistor 162 and the second writing transistor 164 of the writing circuit 160 are conducted. Therefore, the writing circuit 160 provides the system high voltage VDD and the data voltage Vdata respectively to the first terminal and the second terminal of the storage capacitor 150.

Reference is made to FIG. 2 and FIG. 3B. In the second operation period 220, the second control signal S2 and the third control signal S3 have the logic high level, while the first control signal S1 and the light emission signal EM have the logic low level. The light emission control circuit 130 is switched off, that is, the first light emission transistor 132 and the second light emission transistor 134 are switched off. The compensation circuit 140 conducts, by the conducted compensation transistor 142, the control terminal of the driving transistor 110 to the first terminal of the driving transistor 110 so that the driving transistor 110 forms a diode-connected transistor. The first writing transistor 162 of the writing circuit 160 is switched off, and the writing circuit 160 provides the data voltage Vdata to the second terminal of the storage capacitor 150 via the conducted second writing transistor 164. Therefore, the first terminal of the storage capacitor 150 discharges towards the first power terminal NA until the first terminal of the storage capacitor 150 has a voltage approaching to the magnitude shown in the following Formula 1.

$$V1 = VSS\text{comp} + Vth \quad \text{(Formula 1)}$$

In the formulas of this disclosure, the symbol "V1" represents the voltage of the first terminal of the storage capacitor 150; the symbol "VSScomp" represents the voltage received by the second terminal of the driving transistor 110 in the second operation period 220; and the symbol "Vth" represents the threshold voltage of the driving transistor 110.

In a standby period 201 between the second operation period 220 and the third operation period 230, the pixel circuit 100 switches off the light emission control circuit 130, the compensation circuit 140, and the writing circuit 160 in order to maintain voltages at the two terminals of the storage capacitor 150. In some embodiments, in a case that multiple pixel circuits 100 are disposed in a display panel, the standby period 201 is for waiting the pixel circuits 100 in other rows (not shown in FIGS. 2-3) to perform the first operation period 210 and the second operation period 220 thereof.

Reference is made to FIG. 2 and FIG. 3C, in the third operation period 230, the first control signal S1, the second control signal S2, and the third control signal S3 have the logic low level, while the light emission signal EM has the logic high level. The light emission control circuit 130 conducts, by the conducted first light emission transistor 132, the light emission element 120 to the first terminal of the driving transistor 110. The light emission control circuit 130 also conducts, by the conducted second light emission transistor 134, the second terminal of the storage capacitor 150 to the first power terminal NA. In this situation, the data voltage Vdata stored at the second terminal of the storage capacitor 150 is written to the first terminal of the storage capacitor 150 because of the capacitive coupling effect, and the voltage of the first terminal of the storage capacitor 150 may be describe by the following Formula 2. Therefore, the driving transistor 110 is operated in the saturation region to conduct a driving current Idr describe by the following Formula 3, and the driving current Idr flows through the light emission element 120 to cause a corresponding brightness.

$$V1 = VSS\text{comp} + Vh + VSS\text{emi} - V\text{data} \quad \text{(Formula 2)}$$

$$Idr = K(Vgs - Vth)^2 - K(VSS\text{comp} - V\text{data})^2 \quad \text{(Formula 3)}$$

In the formulas of this document, the symbol "VSSemi" represents the voltage received by the second terminal of the driving transistor 110 in the third operation period 230; the symbol "Vgs" represents a voltage difference between the control terminal and the second terminal of the driving transistor 110 in the third operation period 230; and the symbol K represents a product of the carrier mobility, the gate oxide capacitance per unit area, and the width-to-length ratio of the driving transistor 110.

In some embodiments that multiple pixel circuits 100 are disposed in a display panel, all or part of the pixel circuits 100 are commonly coupled with the same power line for providing the system low voltage VSS. Therefore, a significant voltage drop is caused in the third operation period 230 by multiple driving currents Idr flowing simultaneously through the resistor Rs, and thus the pixel circuits 100 in different areas of the display panel may receive different system low voltages VSS in the third operation period 230 (i.e., with respect to different pixel circuits 100, the symbol "VSSemi" in Formula 2 may represent different voltages).

The operation of the pixel circuit 100 further comprises a fourth operation period 240 following the third operation period 230. In the fourth operation period 240, the first control signal S1, the second control signal S2, the third control signal S3, and the light emission signal EM have the logic low level, and thus the light emission control circuit 130, compensation circuit 140, and writing circuit 160 are switched off. The pixel circuit 100 generates luminance which may be determined by the magnitude of the driving current Idr and/or a ratio of the time length of the third operation period 230 to the time length of the fourth operation period 240.

In some embodiments, the pixel circuit 100 needs approximately a quarter of a frame to perform corresponding operations of the first operation period 210, the second operation period 220, and the standby period 201, and needs approximately three quarters of a frame to perform corresponding operations of the third operation period 230 and the fourth operation period 240, but this disclosure is not limited thereto. In practice, the time lengths of the first operation period 210, second operation period 220, the standby period 201, third operation period 230, and the fourth operation period 240 may be adjusted independently according to practical design requirements.

In some embodiments, the control terminal of the second light emission transistor 134 is configured to receive another control signal different from the light emission signal EM. In the third operation period 230, the control signal different from the light emission signal EM may have a rising edge earlier than that of the light emission signal EM.

As can be appreciated from the foregoing descriptions, both of the system low voltage VSS received by the pixel circuit 100 in the third operation period 230 and the threshold voltage of the driving transistor 110 cause little effects to the magnitude of the driving current Idr, and thus the pixel circuit 100 generates correct luminance. In addition, the first control signal 81, the second control signal S2, and the third control signal S3, which have similar waveforms and periodical patterns, can be generated by the same set of shift registers in a display panel to simplify the circuit structure.

Figure 4:
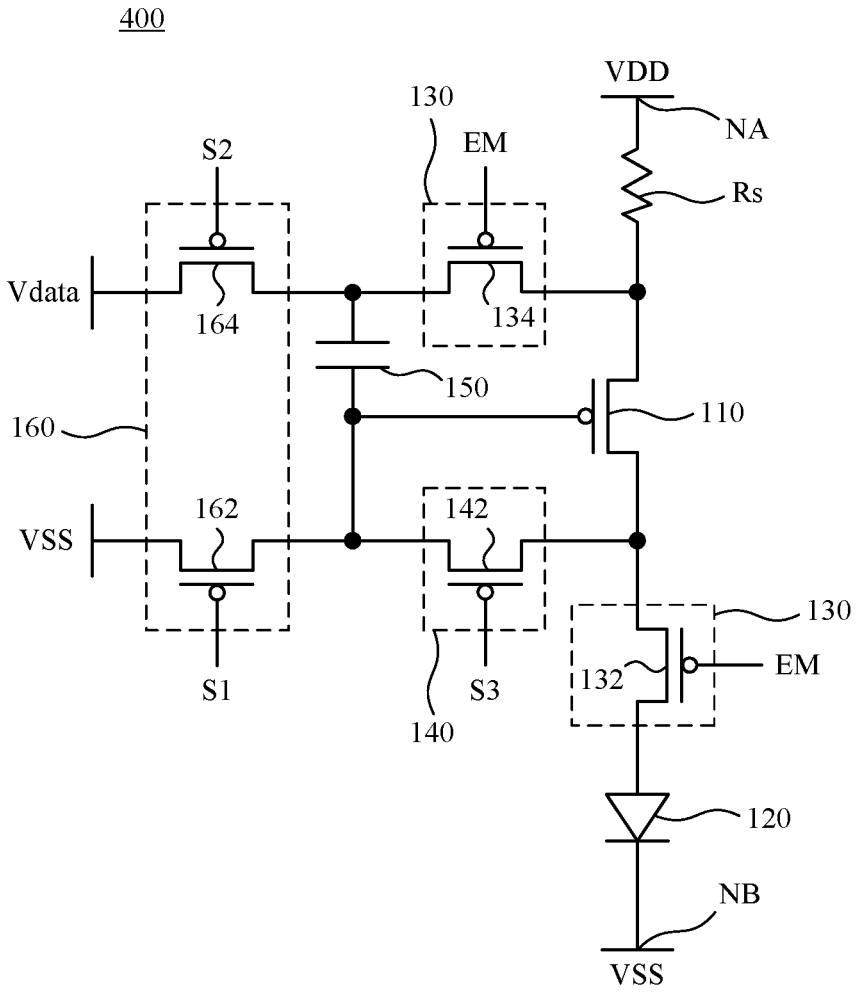
FIG. 4 is a functional block diagram of a pixel circuit according to one embodiment of the present disclosure.

FIG. 4 is a functional block diagram of a pixel circuit 400 according to one embodiment of the present disclosure. The pixel circuit 400 is similar to the pixel circuit 100, one of the differences is that the transistors of the pixel circuit 400 are realized by P-type transistors, and the other difference is that the light emission element 120 of the pixel circuit 400 has a different connection relationship. The first terminal (e.g., the cathode) and the second terminal (e.g., the anode) of the light emission element 120 are respectively coupled with the second power terminal NB and the first terminal of the first light emission transistor 132. In this situation, the first power terminal NA and the second power terminal NB are configured to receive the system high voltage VDD and the system low voltage VSS, respectively, and the second terminal of the first writing transistor 162 is configured to receive the system low voltage VSS.

Figure 5:
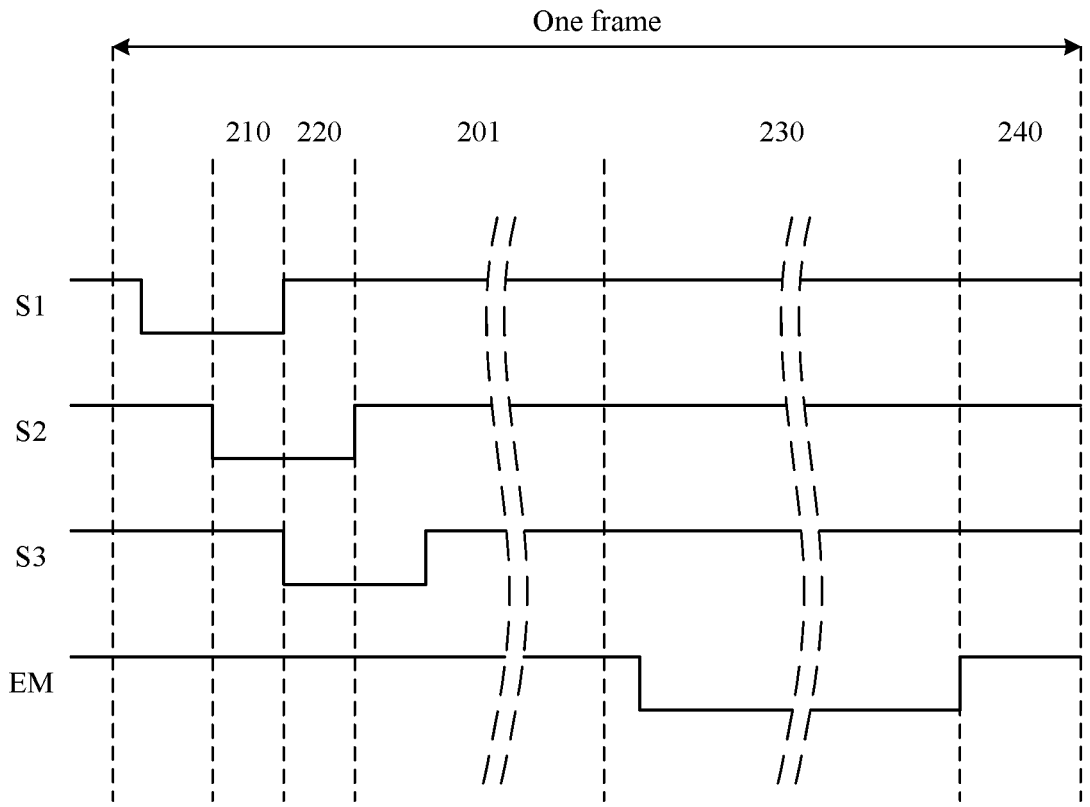
FIG. 5 is a simplified waveform schematic of a plurality of control signals provided to the pixel circuit of FIG. 4 according to one embodiment of the present disclosure.

FIG. 5 is a simplified waveform schematic of a plurality of control signals provided to the pixel circuit 400 according to one embodiment of the present disclosure. The signal waveforms of FIG. 5 are correspondingly opposite to that of FIG. 2. The pixel circuit 400 and the pixel circuit 100 have similar operation processes, the difference is that the logic high level in this embodiment is a low voltage capable of conducting the P-type transistors, and the logic low level in this embodiment is a high voltage capable of switching off the P-type transistors. Therefore, the driving current Idr of the pixel circuit 400 can be substantially immune to the variation of the system high voltage VDD and also the variation of the threshold voltage of the driving transistor 110.

The foregoing descriptions regarding to other corresponding implementations, connections, operations, and related advantages of the pixel circuit 100 are also applicable to the pixel circuit 400. For the sake of brevity, those descriptions will not be repeated here.

Figure 6:
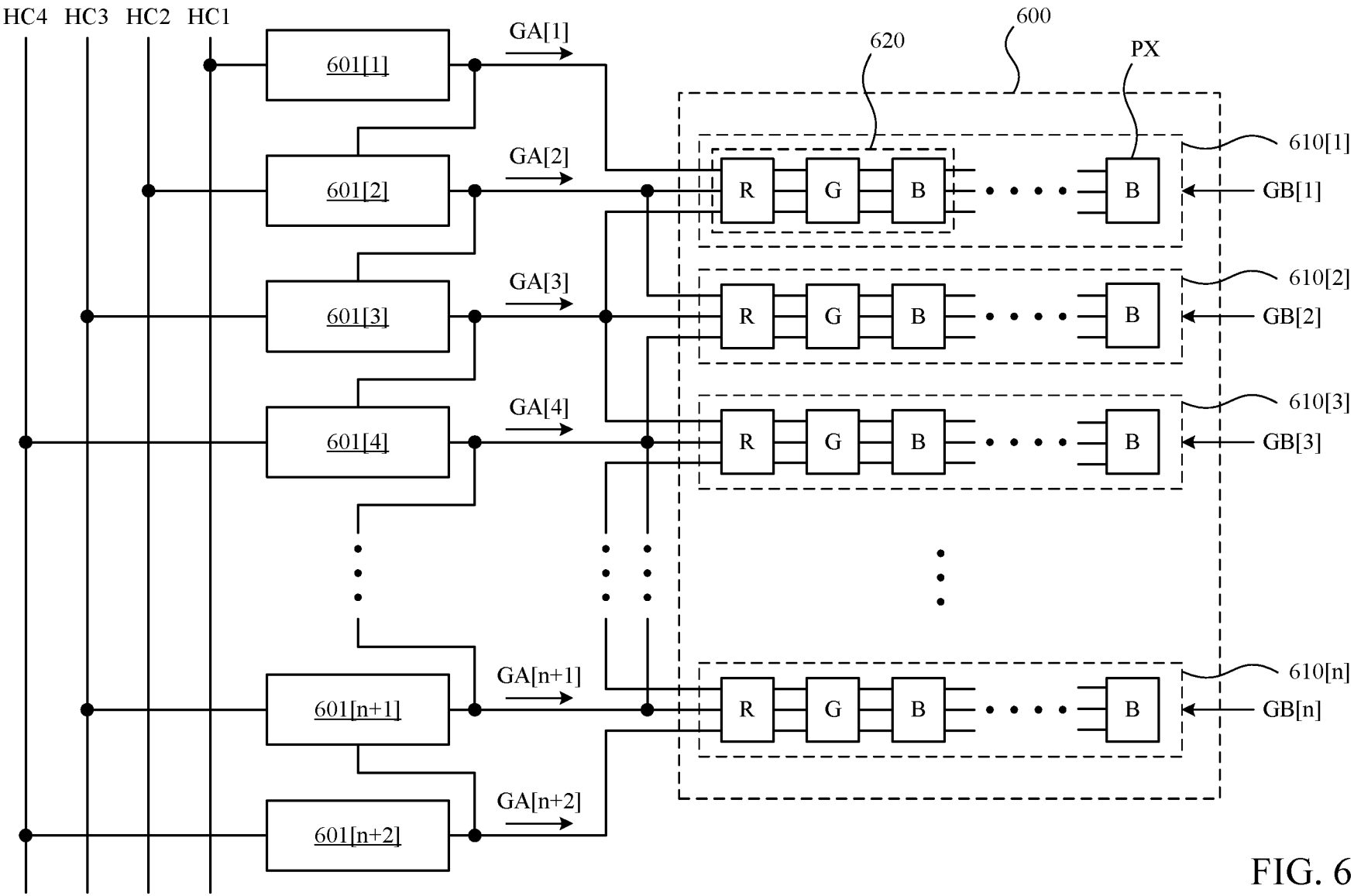
FIG. 6 is a simplified functional block diagram of a pixel array according to one embodiment of the present disclosure.

FIG. 6 is a simplified functional block diagram of a pixel array 600 according to one embodiment of the present disclosure. The pixel array 600 comprises a plurality of pixel circuits PX, and the pixel circuits PX form a plurality of pixel rows 610[1]-610[*n*]. In each of the pixel rows 610[1]-610[*n*], three pixel circuits PX are arranged successively to form a pixel structure 620, and the three pixel circuits PX of the pixel structure 620 are configured to generate the red light, the blue light, and the green light, respectively, but this disclosure is not limited there to. The pixel structure 620 may have a color combination designed according to practical requirements. For example, the pixel structure 620 may comprise four pixel circuits PX configured to provide the red, blue, green, and white light, respectively.

The pixel circuit PX may be realized by the pixel circuit 100 of FIG. 1 or by the pixel circuit 400 of FIG. 4. Referring to FIG. 1 and FIG. 6, the pixel array 600 is configured to receive a plurality of first gate control signals GA[1]-GA[*n*+2] from a plurality of shift registers 601[1]-601[*n*+2]. Each of the pixel rows 610[1]-610[*n*] receives corresponding three of the first gate control signals GA[1]-GA[*n*+2] as the first control signal S1, the second control signal S2, and the third control signal S3.

Each of the pixel rows 610[1]-610[*n*] receives a second control signal S2 the same as the third control signal S3 of the previous pixel row, and also the same as the first control signal S1 of the next pixel row.

For example, the pixel row 610[1] receives the first gate control signals GA[1]-GA[3] respectively as the first control signal S1, the second control signal S2, and the third control signal S3; the pixel row 610[2] receives the first gate control signals GA[2]-GA[4] respectively as the first control signal S1, the second control signal S2, and the third control signal S3; and the pixel row 610[3] receives the first gate control signals GA[3]-GA[5] respectively as the first control signal S1, the second control signal S2, and the third control signal S3. Therefore, the pixel row 610[2] has the second control signal S2 which is the same as the third control signal S3 of the pixel row 610[1] and the first control signal S1 of the pixel row 610[3], and so forth.

The pixel array 600 is further configured to receive a plurality of second gate control signals GB[1]-GB[*n*] from another set of shift registers (not shown in FIG. 6). Each of the pixel rows 610[1]-610[*n*] receives a corresponding one of the second gate control signals GB[1]-GB[*n*] as the light emission signal EM.

Figure 7:
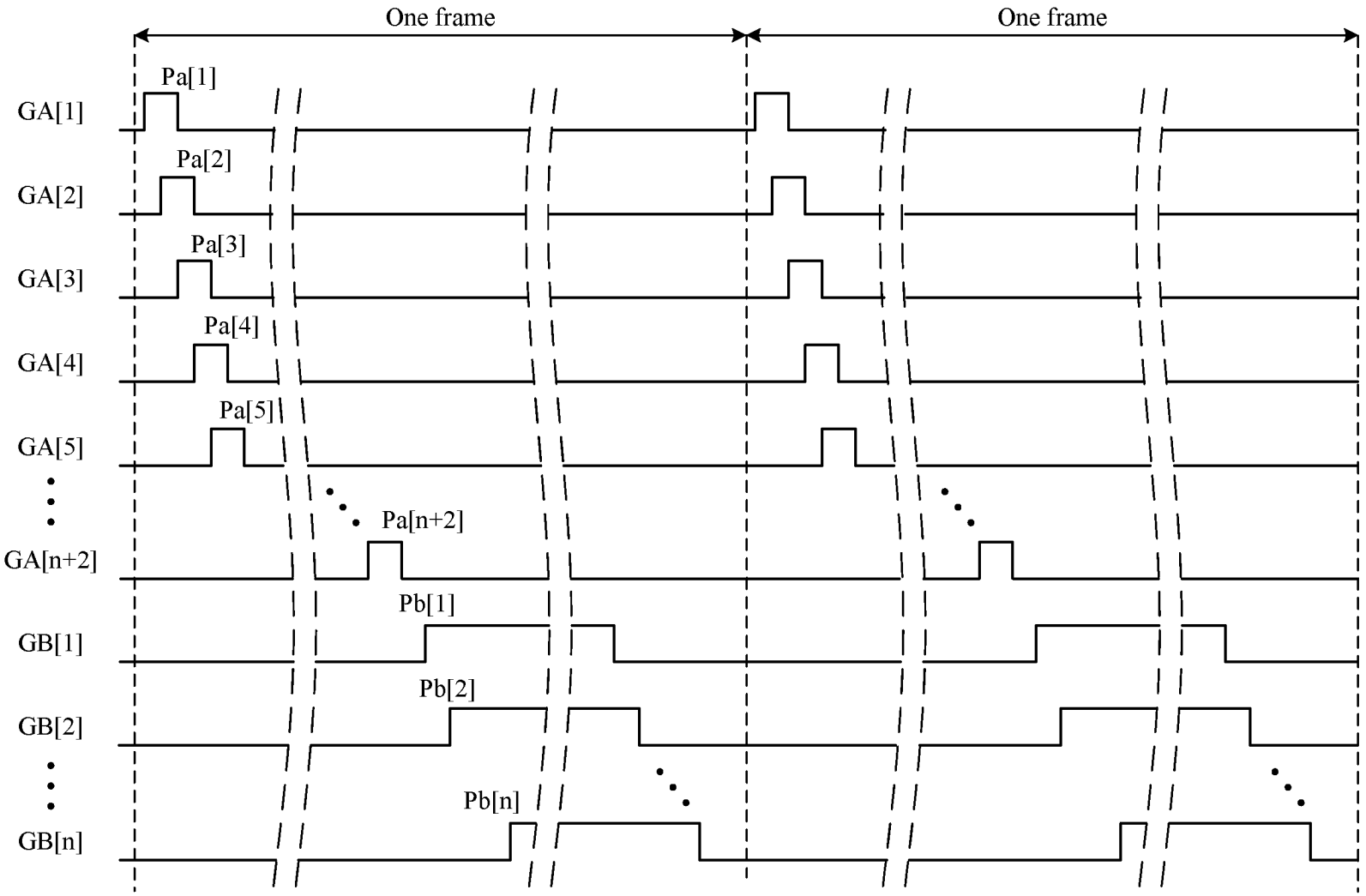
FIG. 7 is a simplified waveform schematic of a plurality of gate control signals provided to the pixel array according to one embodiment of the present disclosure.

FIG. 7 is a simplified waveform schematic of a plurality of gate control signals provided to the pixel array 600 according to one embodiment of the present disclosure. Referring to FIG. 6 and FIG. 7, the shift registers 601[1]-601[*n*] switches the first gate control signals GA[1]-GA[*n*+2] sequentially to logic high level according to clock signals HC1-HC4, so as to sequentially generate a plurality of first pulses Pa[1]-Pa[*n*+2] having the logic high level. The first pulses Pa[1]-Pa[*n*+2] have pulse widths the same as each other. Each of the first pulses Pa[1]-Pa[*n*+2] is partially overlapping with the pervious pulse, and is also partially overlapping with the next pulse.

For example, the first pulse Pa[2] is partially overlapping with the first pulse Pa[1], and is also partially overlapping with the first pulse Pa[3]. The first pulse Pa[4] is partially overlapping with the first pulse Pa[3] and the first pulse Pa[5], and so on.

In addition, each of first pulses Pa[1]-Pa[*n*+2] is not overlapping with the pulses former to the previous pulse, and also is not overlapping with the pulses following the next pulse.

For example, the first pulse Pa[3] is not overlapping with the first pulse Pa[1], and also is not overlapping with the first pulse Pa[5]. The first pulse Pa[4] is not overlapping with the first pulse Pa[2] and the first pulse Pa[6], and so forth.

The second gate control signals GB[1]-GB[*n*] are sequentially switched to the logic high level to sequentially generate a plurality of second pulses Pb[1]-Pb[*n*] having the logic high level. The second pulses Pb[1]-Pb[*n*] are not overlapping with the first pulses Pa[1]-Pa[*n*+2].

In some embodiments, the first pulses Pa[1]-Pa[*n*+2] are generated approximately within the first quarter of a frame, and the second pulses Pb[1]-Pb[*n*] are generated approximately within the last three quarters of the frame, but this disclosure is not limited thereto.

In one embodiment, all of the pixel rows 610[1]-610[*n*] receive the same second gate control signal as their light emission signal EM, that is, all of the pixel circuits PX receive the same light emission signal EM to emit light simultaneously. As a result, the circuit area can be further reduced.

Figure 8:
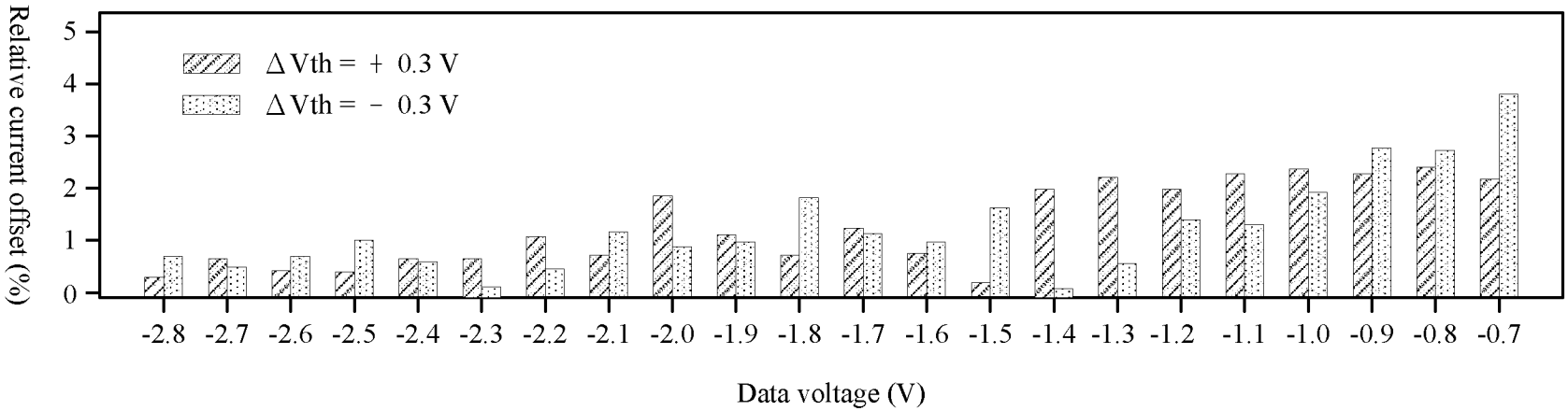
FIG. 8 is a schematic diagram for illustrating the relative current offsets of the pixel circuit of FIG. 1 under various threshold voltages of the driving transistor.

FIG. 8 is a schematic diagram for illustrating the relative current offsets of the pixel circuit 100 under circumstances that the threshold voltage of the driving transistor 110 has variations. The relative current offsets of FIG. 8 may be calculated by using the following Formula 4.

$$Err = \frac{Iv - I(0)}{I(0)} \times 100\% \quad \text{(Formula 4)}$$

In the formulas of this disclosure, the symbol "Err" represents the relative current offset; the symbol "Iv" represents the driving current Idr in which the threshold voltage of the driving transistor 110 has variations; the symbol "I(0)" represents the driving current Idr in which the pixel circuit 100 has no characteristic variations. In this embodiment, the variations in the threshold voltage of the driving transistor 110 (represented by the symbols "ΔVth" in FIG. 8) are set to 0.3 and −0.3 V.

Figure 9:
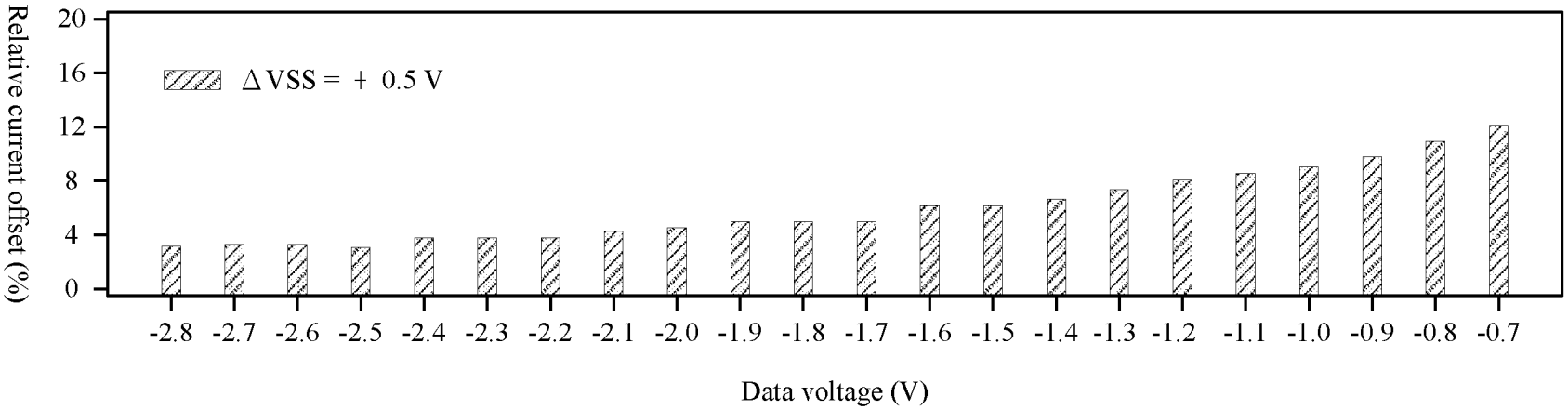
FIG. 9 is a schematic diagram for illustrating the relative current offsets of the pixel circuit of FIG. 1 under various system low voltages.

FIG. 9 is a schematic diagram for illustrating the relative current offsets of the pixel circuit 100 under circumstances that the system low voltage VSS has variations. The relative current offsets of FIG. 9 may be calculated by using the following Formula 5.

$$Err = \frac{Iss - I(0)}{I(0)} \times 100\% \quad \text{(Formula 5)}$$

In the formulas of this disclosure, the symbol "Iss" represents the driving current Idr in which the system low voltage VSS has variations. In this embodiment, the variation in the system low voltage VSS (represented by the symbol "ΔVSS" in FIG. 9) is 0.5 V.

As can be appreciated from the foregoing descriptions, the pixel circuit 100 can conduct the driving current Idr with the correct magnitude under the situations that the threshold voltage of the driving transistor 110 or the system low voltage VSS has variations.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the present disclosure will be apparent to those skilled in the art from consideration of the specification and practice of the present disclosure disclosed herein. It is intended that the specification and examples be considered as exemplary only, with a true scope and spirit of the present disclosure being indicated by the following claims.

What is claimed is:

1. A pixel circuit, comprising:

a driving transistor;

a light emission element;

a light emission control circuit, configured to selectively conduct the light emission element to the driving transistor, including:

a first light emission transistor having a control terminal to receive a light emitting signal; and a second light emission transistor having a control terminal to receive the light emitting signal;

a compensation circuit, directly coupled with the light emission control circuit and a control terminal of the driving transistor, and configured to form a diode-connected structure with the driving transistor, wherein the compensation circuit comprises a compensation transistor;

a storage capacitor, comprising a first terminal and a second terminal, wherein the first terminal of the storage capacitor is directly coupled with both of the control terminal of the driving transistor and a terminal of the compensation transistor, and the light emission control circuit is configured to selectively conduct the second terminal of the storage capacitor to a first power terminal, and wherein the second terminal of the storage capacitor is directly coupled with a terminal of the second light emission transistor; and a writing circuit, configured to provide different voltages to the first terminal of the storage capacitor and the second terminal of the storage capacitor.

2. The pixel circuit of claim 1, wherein the driving transistor further comprises a first terminal and a second terminal, and the light emission control circuit further comprises:

a first light emission transistor, comprising a first terminal and a second terminal, wherein the first terminal of the first light emission transistor is coupled with the light emission element, the second terminal of the first light emission transistor is coupled with the first terminal of the driving transistor and the compensation circuit; and a second light emission transistor, comprising a first terminal and a second terminal, wherein the first terminal of the second light emission transistor is coupled with the second terminal of the driving transistor and the first power terminal, and the second terminal of the second light emission transistor is coupled with the second terminal of the storage capacitor.

3. The pixel circuit of claim 2, wherein the control terminal of the first light emission transistor and the control terminal of the second light emission transistor are configured to receive different signals.

4. The pixel circuit of claim 2, wherein the control terminal of the first light emission transistor and the control terminal of the second light emission transistor are configured to receive a light emission signal.

5. The pixel circuit of claim 4, wherein the writing circuit comprises:

a first writing transistor, comprising a first terminal, a second terminal, and a control terminal, wherein the first terminal of the first writing transistor is coupled with the control terminal of the driving transistor, the second terminal of the first writing transistor is configured to receive a system high voltage or a system low voltage, and the control terminal of the first writing transistor is configured to receive a first control signal; and a second writing transistor, comprising a first terminal, a second terminal, and a control terminal, wherein the first terminal of the second writing transistor is coupled with the second terminal of the storage capacitor, the second terminal of the second writing transistor is configured to receive a data voltage, and the control terminal of the second writing transistor is configured to receive a second control signal.

6. The pixel circuit of claim 5, wherein the compensation circuit comprises:

a compensation transistor, comprising a first terminal, a second terminal, and a control terminal, wherein the first terminal of the compensation transistor is coupled with the first terminal of the driving transistor, the second terminal of the compensation transistor is coupled with the control terminal of the driving transistor, and the control terminal of the compensation transistor is configured to receive a third control signal.

7. The pixel circuit of claim 6, wherein the first control signal, the second control signal, and the third control signal are configured to provide a first pulse, a second pulse, and a third pulse, respectively, and the second pulse is partially overlapping with the first pulse and the third pulse.

8. The pixel circuit of claim 7, wherein the first pulse, the second pulse, and the third pulse have pulse widths the same as each other.

9. A pixel array, comprising:

a plurality of pixel circuits, arranged to from n pixel rows, wherein each of the n pixel rows receives corresponding three of a plurality of first gate control signals as a first control signal, a second control signal, and a third control signal, n is a positive integer, and each of the plurality of pixel circuits comprising:

a driving transistor;

a light emission element;

a light emission control circuit, configured to selectively conduct the light emission element to the driving transistor, including:

a first light emission transistor having a control terminal to receive a light emitting signal; and a second light emission transistor having a control terminal to receive the light emitting signal;

a compensation circuit, directly coupled with the light emission control circuit and a control terminal of the driving transistor, and configured to form a diode-connected structure with the driving transistor according to the third control signal, wherein the compensation circuit comprises a compensation transistor;

a storage capacitor, comprising a first terminal and a second terminal, wherein the first terminal of the storage capacitor is directly coupled with both of the control terminal of the driving transistor and a terminal of the compensation transistor, and the light emission control circuit is configured to selectively conduct the second terminal of the storage capacitor to a first power terminal, and wherein the second terminal of the storage capacitor is directly coupled with a terminal of the second light emission transistor; and a writing circuit, configured to provide, according to the first control signal and the second control signal, different voltages to the first terminal of the storage capacitor and the second terminal of the storage capacitor.

10. The pixel array of claim 9, wherein the second control signal provided to an i-th pixel row of the n pixel rows is the third control signal of an (i−1)-th pixel row of the n pixel rows and the first control signal of an (i+1)-th pixel row of the n pixel rows, and i is a positive integer less than n.

11. The pixel array of claim 9, wherein the first control signal, the second control signal, and the third control signal are configured to provide a first pulse, a second pulse, and a third pulse, respectively, and the second pulse is partially overlapping with the first pulse and the third pulse.

12. The pixel array of claim 9, wherein the plurality of first gate control signals have pulse widths the same as each other.

13. The pixel array of claim 9, wherein the driving transistor further comprises a first terminal and a second terminal, and the light emission control circuit further comprises:

a first light emission transistor, comprising a first terminal and a second terminal, wherein the first terminal of the first light emission transistor is coupled with the light emission element, the second terminal of the first light emission transistor is coupled with the first terminal of the driving transistor and the compensation circuit; and a second light emission transistor, comprising a first terminal and a second terminal, wherein the first terminal of the second light emission transistor is coupled with the second terminal of the driving transistor and the first power terminal, and the second terminal of the second light emission transistor is coupled with the second terminal of the storage capacitor.

14. The pixel array of claim 13, wherein the control terminal of the first light emission transistor and the control terminal of the second light emission transistor are configured to receive different signals.

15. The pixel array of claim 13, wherein the control terminal of the first light emission transistor and the control terminal of the second light emission transistor are configured to receive a light emission signal.

16. The pixel array of claim 15, wherein the writing circuit comprises:

a first writing transistor, comprising a first terminal, a second terminal, and a control terminal, wherein the first terminal of the first writing transistor is coupled with the control terminal of the driving transistor, the second terminal of the first writing transistor is configured to receive a system high voltage or a system low voltage, and the control terminal of the first writing transistor is configured to receive the first control signal; and a second writing transistor, comprising a first terminal, a second terminal, and a control terminal, wherein the first terminal of the second writing transistor is coupled with the second terminal of the storage capacitor, the second terminal of the second writing transistor is configured to receive a data voltage, and the control terminal of the second writing transistor is configured to receive the second control signal.

17. The pixel array of claim 16, wherein the compensation circuit comprises:

a compensation transistor, comprising a first terminal, a second terminal, and a control terminal, wherein the first terminal of the compensation transistor is coupled with the first terminal of the driving transistor, the second terminal of the compensation transistor is coupled with the control terminal of the driving transistor, and the control terminal of the compensation transistor is configured to receive the third control signal.

18. The pixel array of claim 17, wherein each of the n pixel rows receives a corresponding one of a plurality of second gate control signals as the light emission signal.

19. The pixel array of claim 17, wherein all of the plurality of pixel circuits are configured to receive the light emission signal.

20. A pixel structure, comprising:

a first pixel;

a second pixel; and a third pixel, wherein each of the first pixel, the second pixel, and the third pixel comprises:

a driving transistor;

a light emission element;

a light emission control circuit, configured to selective conduct the light emission element to the driving transistor, including:

a first light emission transistor having a control terminal to receive a light emitting signal; and a second light emission transistor having a control terminal to receive the light emitting signal;

a compensation circuit, directly coupled with the light emission control circuit and a control terminal of the driving transistor, and configured to form a diode-connected structure with the driving transistor, wherein the compensation circuit comprises a compensation transistor;

a storage capacitor, comprising a first terminal and a second terminal, wherein the first terminal of the storage capacitor is directly coupled with both of the control terminal of the driving transistor and a terminal of the compensation transistor, and the light emission control circuit is configured to selectively conduct the second terminal of the storage capacitor to a first power terminal, and wherein the second terminal of the storage capacitor is directly coupled with a terminal of the second light emission transistor; and a writing circuit, configured to provide different voltages to the first terminal of the storage capacitor and the second terminal of the storage capacitor, wherein the light emission element of the first pixel, the light emission element of the second pixel, and the light emission element of the third pixel are configured to generate red light, green light, and blue light, respectively.

* * * * *